United States Patent [19]

Greenwood et al.

[11] 3,955,349

[45] May 11, 1976

[54] PROCESS AND APPARATUS FOR CONTROLLING TWIST DENSITY DURING TEXTURING

[75] Inventors: Kurt Greenwood, Ulisbach; Philippe Lanz, Wattwil, both of Switzerland

[73] Assignee: Heberlein & Co. AG, Wattwil, Switzerland

[22] Filed: Apr. 28, 1975

[21] Appl. No.: 572,077

[30] Foreign Application Priority Data

May 22, 1974 Switzerland ..... 7013/74

[52] U.S. Cl. ..... 57/34 HS; 57/157 TS

[51] Int. Cl.[2] ..... D02G 1/02

[58] Field of Search ..... 57/34 R, 34 HS, 106, 57/157 R, 157 TS, 157 MS

[56] References Cited

UNITED STATES PATENTS

| | | | |
|---|---|---|---|
| 3,261,155 | 7/1966 | Kunzle | 57/34 HS |
| 3,355,872 | 12/1967 | Gilchrist et al. | 57/34 HS X |
| 3,683,611 | 8/1972 | Buzano | 57/34 HS X |
| 3,747,317 | 7/1973 | Willis | 57/106 |
| 3,812,664 | 5/1974 | Schippers | 57/34 HS |

*Primary Examiner*—Donald E. Watkins

*Attorney, Agent, or Firm*—Larson, Taylor and Hinds

[57] ABSTRACT

Apparatus and processes are described in which a friction twist imparter is used to twist two filaments or filament bundles while passing through a processing zone in which the filaments are textured by imparting a temporary high twist to the filaments and heat-setting the twisted filaments. Variations in twist density due to variations in the co-efficient of friction between the ply-yarn and twist imparter are controlled by separating the ply-yarn into two separate filaments or bundles of filaments at a point beyond the friction imparter and sensing variations in the position of the separation point, the wrap angle or tension, or both, of the ply-yarn leaving the friction twist imparter being adapted to such variations. The means for this particularly described are mechanical and include a spring-loaded lever projecting between the separated filaments at the separation point so as to follow changes in the position of this point. The lever actuates an irreversible worm gear to position a movable thread-guide through which the ply-yarn passes on its way from the twist-imparter to the separation point, thereby adjusting the wrap angle. The mechanism may be arranged so that the position of the separation point directly determines the position of the thread-guide, or so that the separation point only determines the direction of movement of the thread-guide.

9 Claims, 4 Drawing Figures

PROCESS AND APPARATUS FOR CONTROLLING TWIST DENSITY DURING TEXTURING

FIELD OF THE INVENTION

This invention relates to apparatus and processes for controlling the twist density while texturing filaments or filament bundles of thermoplastic material.

DESCRIPTION OF THE PRIOR ART

In known processes for crimping thermoplastic filaments or filament bundles, the filament is temporarily high-twisted by false-twisting and heat-set in this condition. False-twisting may be effected either by means of a pin twist imparter or by means of a friction twist imparter. Practice has shown that, with pin twist imparters, only limited production rates are achievable and that an essential increase of the production rate is probably only possible with a friction twist imparter. The latter has however the disadvantage that is it not possible to fix the twist density of the filaments exactly and to keep it constant over a long period of time. The essential reason for this is that, with friction twist imparters, the degree of twist imparted depends much on the co-efficient of friction between the filament and twist imparter and that the friction may easily vary due to soiling and other circumstances. It is the purpose of the present invention to eliminate this disadvantage of friction twist imparters by means of a twist control system and to make it possible thereby to fix the twist density exactly and to keep the twist density stable for a substantially unlimited period of time.

SUMMARY OF THE INVENTION

Accordingly, one aspect of the present invention consists in a process for controlling the twist density, while texturing filaments or filament bundles of thermoplastic material, by imparting a temporary twist and heat-setting the filaments or filament bundles in the high-twisted condition, two separate filaments or filament bundles being ply-twisted together and separated again and the ply-yarn being continuously driven within the zone of the separation point by means of a friction twist imparter and the position of the point of separation being continuously sensed on the prolonged axis of the ply-yarn while the ply-twist density is controlled in direct dependency on the position of the separation point by adapting the wrap angle ($\alpha$) at which the ply-yarn is guided over the friction twist imparter and/or of the filament tension, to the sensed position of the separation point.

Thus, the twist control system requires two filaments to be ply-twisted together and again separated by a separating device. It is however also possible under certain circumstances to use only one filament and to split the same up into two halves during the process, ply-twist the same and again separate them. It is also possible either to wind up the two filaments or filament halves, after they have left the separating device, either on two separate bobbins or together and to process them as one thread. Experiments have shown that two filaments, provided that they have little or no twist before ply-twisting, in practice cannot be distinguished from a single filament of the same titer after having been wound onto a bobbin together.

In the proposed serial arrangement of a friction twist imparter and of a separating device, the twist in the processing zone, i.e., between the point of filament assembly and the twist imparter, only depends on the friction twist imparter. As long as the twist imparter imparts to the filament the desired twist, the filament leaves the twist imparter in a twistless condition, i.e., the point of separation lies near the twist imparter, and the separating device does not bring about any adjustment. To achieve this condition, it is necessary to impart to the filaments, before starting the machine, the number of pre-twists which, in the processing zone, yields the desired twist density, for example, by means of a twist motor.

As soon as, however, the friction twist imparter imparts to the ply-yarn a twist density which is different from the desired twist density, i.e., the twist density determined by pre-twist, twist is produced in the separation zone, i.e., between the twist imparter and the point of separation in such a manner that, even with small variations of the twist density in the processing zone, a very high twist density arises in the separation zone because the latter is much shorter than the processing zone. If the twist density in the processing zone is too high with respect to the desired value, then the twist in the separation zone is reversed. If it is too low, the twist in the separation zone stays in the same sense. In both cases, however, difficulties arise very soon. This problem becomes apparent from the following numerical example.

Assuming the length of the processing zone is 2 meters and the length of the separation zone 10 cm, and if the desired twist density in the processing zone is assumed to be 2500 turns per meter, then to obtain the twist density, a twist number of $2 \times 2500 = 5000$ turns per meter has to be imparted to the two filaments. If now, for example, the twist density in the processing zone diminishes by 5%, i.e., by 125 turns per meter, the total number of twists is thereby reduced by 250 turns, and these turns are found in the separation zone which is only 10 cm long. The twist density in the separation zone therefore amounts to at least 2500 turns per meter. In fact however, it is much higher both because these turns must lie between the twist imparter and the point of separation and because the latter is less than 10 cm away from the other end of the separation zone. Practice has furthermore shown that the twist density of the ply-yarn when using a friction twist imparter frequently varies which causes the separation point to move to and fro over a distance of several centimeters along an extension of the axis of the ply-yarn. The present invention uses this discovery to control the twist density in the processing zone and to make the necessary corrections to avoid variations in this twist density.

DESCRIPTION OF THE DRAWINGS

The present invention can be realized in various forms, and two examples are explained hereinafter in more detail with reference to the accompanying drawings, wherein:

FIG. 4 shows a perspective view of a further embodiment of a control device for use in the apparatus of

FIG. 1.

Figure 1:
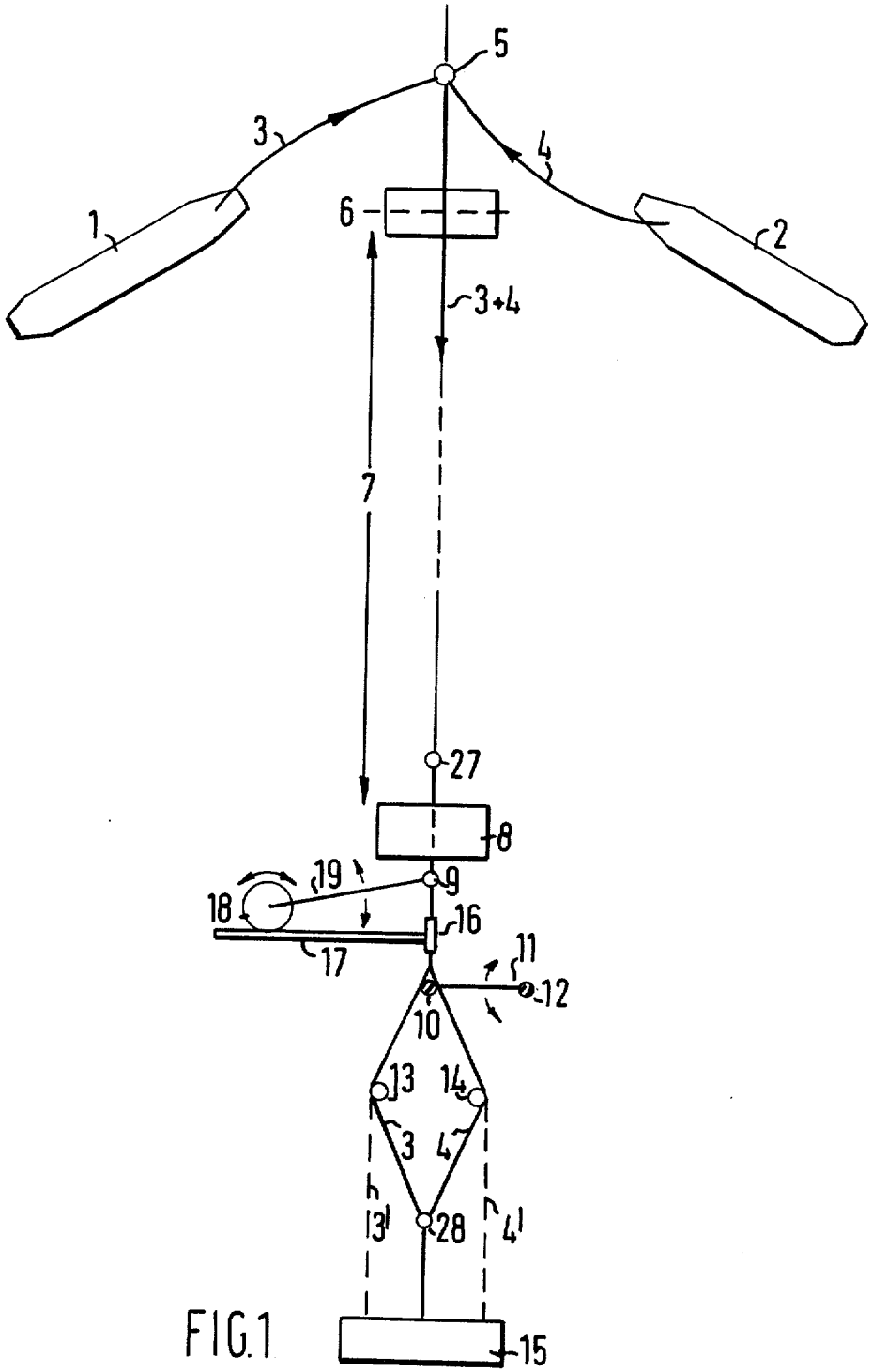
FIG. 1 schematically shows a complete apparatus for controlling filament twist density.

According to FIG. 1, two filaments 3 and 4 are withdrawn from bobbins 1 and 2 by feed roller 6 and pass into a processing zone 7 through thread-guide 5 and over feed rollers 6. The processing zone comprises a heating and a cooling device and is shown here only partially. Near to the end of the processing zone, there is a stationary thread-guide 27. The ply-yarn 3 and 4 subsequently passes through the same, through a friction twist imparter 8, through movable thread-guide 9 and is then separated by separation rollers 13 and 14. The separation point lies between thread-guide 9 and separation rollers 13 and 14 and depends on the number of twists in the separation zone. After having left the separation rollers 13 and 14, the filaments 3 and 4 may either be assembled into a single yarn in the thread-guide 28 or wound up separately as 3′ and 4′. In both cases, the filaments or respectively the yarn are transported by the feed rollers 15. In the separation point and between filaments 3 and 4, there is a separation point sensor 10 which is fixed on lever 11. The latter is swivellably fixed on shaft 12.

Figure 2:
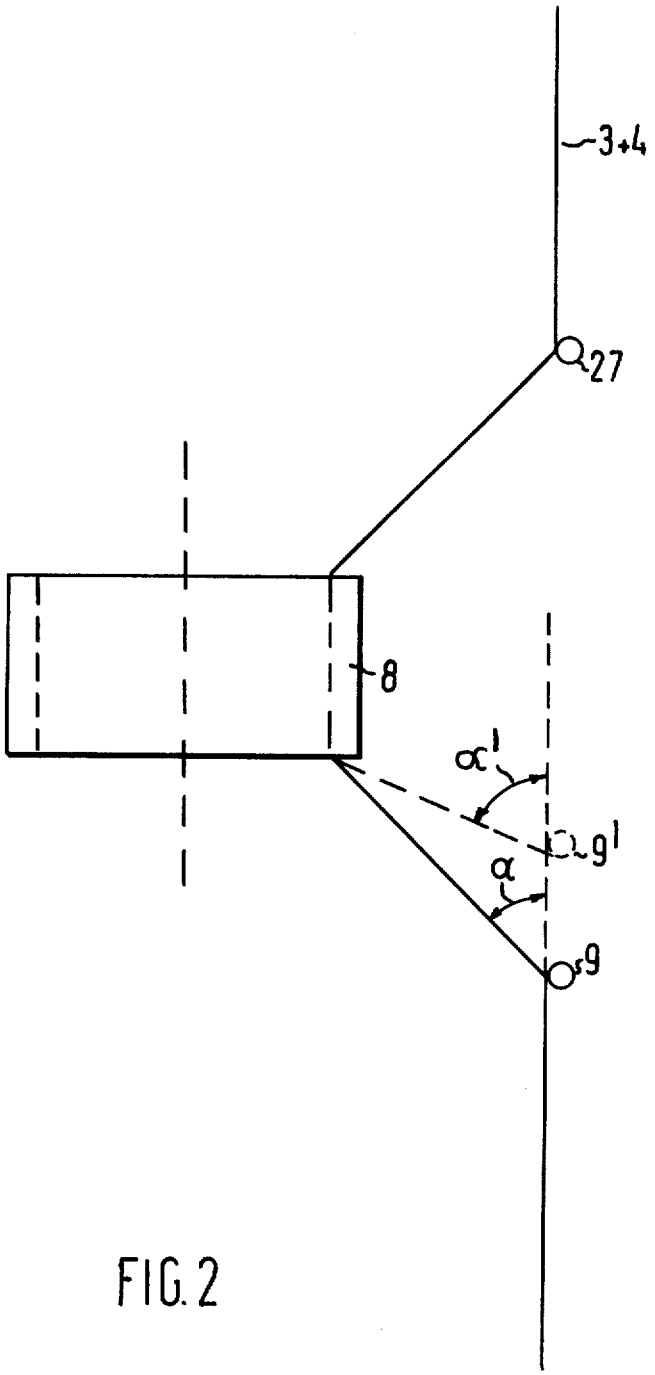
FIG. 2 schematically shows a lateral elevation of a friction twist imparter on an enlarged scale, for use in the apparatus of FIG. 1.

FIG. 2 shows the friction twist imparter 8 in the shape of a cylindrical ring and the nearby thread-guides 27 and 9. FIG. 2 shows how the wrap angle is influenced by vertical movement of movable thread-guide 9. Lifting of thread-guide 9 increases the wrap angle and thereby the twist density in the processing zone. For example, lifting the thread guide 9 to the position 9′ increases the wrap angle $\alpha$ to $\alpha'$.

Figure 3:
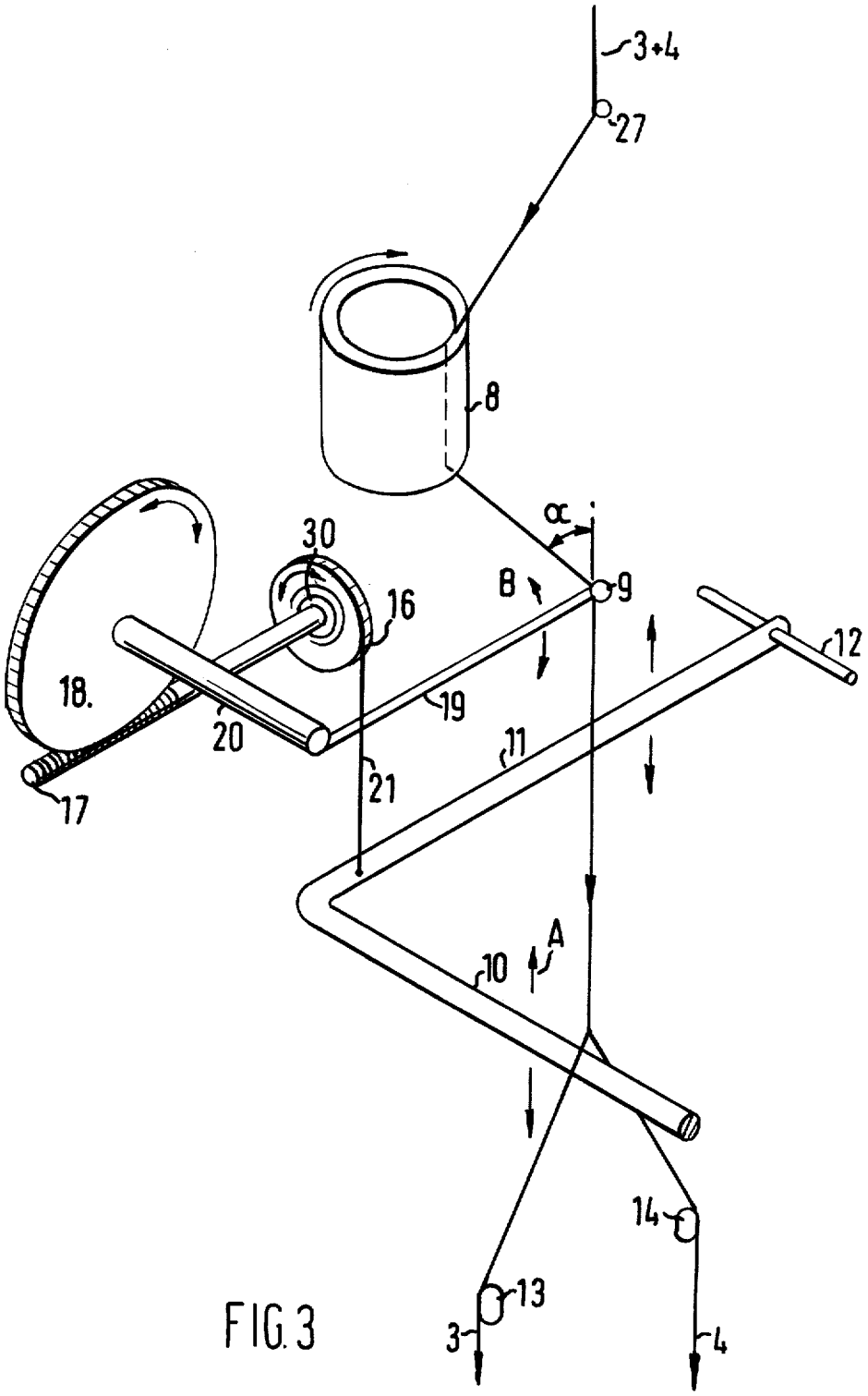
FIG. 3 shows a perspective view of a first embodiment of a control device for use in the apparatus of FIG. 1.

In the control device according to FIG. 3, the separation point sensor 10 is fixed on lever 11 swivellable around shaft 12, and the latter is connected with the rotatable disc 16 by a strong inelastic cord 21. The cord 21 is wrapped round the rotatable disc 16 and fixed on the same. A weak torsion spring 30 acts on the rotatable disc 16 so that the cord 21 is kept under slight tension and can thereby easily follow the variations of the position of the separation point. The rotatable disc 16 is fixed on one end of a worm shaft 17. A worm wheel 18 is in engagement with this worm shaft 17 and thereby forms a worm gear with shaft 17. Worm wheel 18 is supported by shaft 20 and rigidly connected with the same. On shaft 20, a lever 19 is fixed which carries the movable thread-guide 9.

When using this control device, it is necessary to use a friction twist imparter 8 which, with a central position of thread-guide 9 and a medium co-efficient of friction between the twist imparter and filaments, can impart to the latter approximately the desired filament twist density. If, for example, in a processing zone 2 meters long, it is desired to impart to the yarn a twist density of 2500 turns per meter, not 5000, but only 4800 turns per meter are imparted to the two filaments. If the desired twist in the S-direction, this means that, if the friction twist imparter 8 operates correctly, the twist density in the processing zone is 2500 twists per meter and that there are 200 Z turns in the separation zone. This furthermore means that the separation point is not near the thread-guide 9, but approximately in the middle of the separation zone. If the number of S-turns is increased in the processing zone, also the number of Z-turns in the separating zone is increased and vice versa. Accordingly, the separation point sensor 10, with increasing twist density moves downwards in the processing zone and upwards if the twist density is reduced.

After the ply-twist has been imparted, the machine is adjusted and, if the friction twist imparter 8 operates correctly, the separation point assumes a central position. If, for example, the friction co-efficient between twist imparter and the filaments decreases, the twist density in the processing zone and also in the separation zone decreases. The separation point sensor 10 accordingly follows the separation point under the influence of the torsion spring 30 of the rotatable disc 16 in direction of arrow A and, at the same time, the rotatable disc 16 rotates. This is transmitted to the thread-guide 9 by worm-gear 17, 18, shaft 20 and lever 19, the thread-guide 9 being thereby moved in direction of arrow B and thus increasing the wrap angle $\alpha$. Thereby, the number of twists imparted by the friction twist imparter is increased and thereby the originally existing difference eliminated. The use of worm gear 17, 18 makes it possible for the thread-guide 9 to be moved by the small force of torsion spring 30 against the high yarn tensions which act on the thread-guide 9. On the other hand, the worm gear 17, 18 prevents these tensions from influencing the position of thread-guide 9 and of separation point sensor 10.

Beside the shown elements, the control device of FIG. 3 furthermore comprises at least one stop member (not shown), for it is necessary to disable the control device if the separation point sensor 10 approaches the twist imparter 8 too closely. If the separation point sensor quite nearly approaches the twist imparter, it cannot differentiate between an increase and a decrease of twist density, and it may happen that it does not correct, but increases a reduction of the twist density.

If, when the separation point approaches the twist imparter 8, the quality of the crimp yarn has already diminished too much, not only the control device, but at the same time also the texturing machine itself must be stopped. If, however, after the control device has been stopped, the yarn quality is still acceptable, the whole texturing machine can be stopped separately by means of a further stop device if the separation point sensor 10 indicates that the twist density has become lower than the tolerable minimum. By means of signal lights, the operating staff can be informed about the condition which has arisen so that a corresponding correction can be made.

Figure 4:
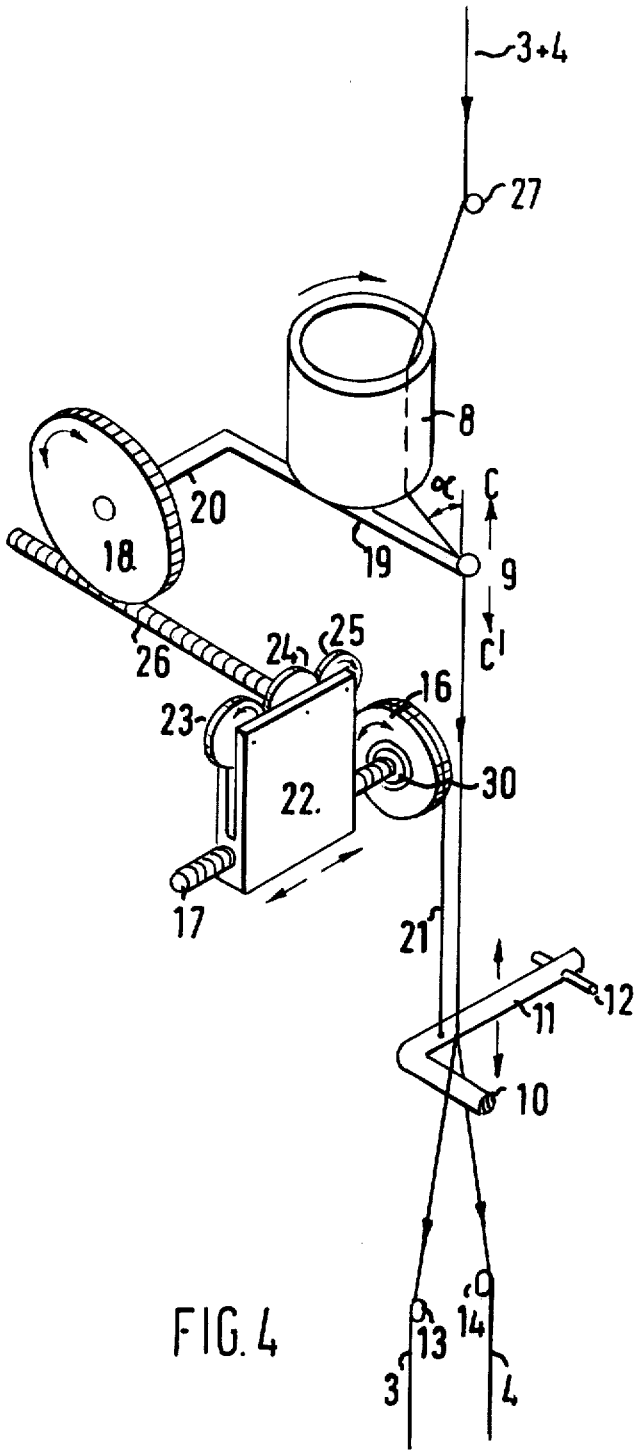

The control device according to FIG. 3 is mainly suitable for smaller variations of the co-efficient of friction between the twist imparter and the filaments. For the correction of larger variations of the coefficient of friction, a further embodiment of the control device, shown in FIG. 4, is suitable which, as far as the separation point sensor 10 and the force transmission from the latter to the worm shaft 17 is concerned, is identical with the embodiment of FIG. 3. Also the transmission of movement between worm wheel 18 and movable thread-guide 9 is essentially the same as in the device of FIG. 3. On the other hand, between shaft 17 and worm-wheel 18, there are provided the movable carriage 22 with discs 23, 24 and 25 and worm shaft 26. The carriage 22 has a horizontal cylinder bore with an inner screw-thread with which the worm shaft 17 is in mesh. When rotating this shaft, the carriage 22 accordingly effects a horizontal movement. On the upper part of carriage 22, the two discs 23 and 25 are supported for rotation about their shafts which are driven in opposite directions by a drive not shown. On one end of the worm shaft 26, there is provided a disc 24 which drives the shaft 26. Depending on the position of carriage 22, the disc 24 is either out of contact with the two other discs 23, 25, or in contact with disc 23 or with disc 25. When in contact with one of the two discs 23, 25, the disc 24 is driven by frictional contact. This disc may accordingly either stand still or be rotated in one or the other direction. The rotation of disc 24 is transmitted by shaft 26, worm-wheel 18, shaft 20 and lever 19 to thread-guide 9. The latter is accordingly moved, depending on the sense of rotation of disc 24, either in the direction of arrow C or in the direction of arrow C'.

With a normal twist density in the processing zone, the carriage 22 is in a central position where the disc 24 has no contact with the adjacent discs 23, 25 and therefore stands still. If the twist density diminishes, the position of the separation point and of the separation point sensor 10 varies, and this causes the shaft 17 to rotate about its axis and the carriage 22 to move horizontally, whereby the disc 24 is brought into frictional contact with one or the other of the two discs 23, 25 which moves the thread-guide 9 in direction of the arrow C by means of the further transmission mechanism. Thereby, the wrap angle $\alpha$ and the twist density of the ply-yarn are increased. The latter brings the separation point back into its original position, and this brings the carriage 22 back into the position in which the disc 24 is not driven. Accordingly, the thread-guide 9 now remains in its new position until a new variation of the twist density calls for a new displacement. The essential difference between the control devices of FIGS. 3 and 4 is that, in the first embodiment, the position of the separation point directly determines the position of the thread-guide 9 whereas, in the second embodiment, the position of the point of separation only determines the direction of movement of thread-guide 9.

The control device of FIG. 4 is particularly suitable for correcting those variations in twist density which may arise due to the friction twist imparter 8 becoming soiled as the operation continues over a prolonged period.

The two control devices particularly described above are only examples of the invention. However, the latter may be realized in various other forms. It is for example possible to use, instead of a mechanical separation point sensor, an optical, electrical or electronic sensor.

Also, the force transmission of the twist control in the twist imparter 8 may not only be effected mechanically, but also electrically or electronically or by a fluid-controlled system. Furthermore, the twist control itself may not only be effected by variation of the wrap angle, but for example also by variation of the filament tension.

Both control devices particularly described above not only have the advantage that the twist density of the yarn remains constant to a great extent, and is adjustable precisely, they also offer an advantage with respect to the behaviour when thread breakages occur. In the known false-twist texturing machines with pin twist imparters or with friction twist imparters, a thread breakage causes an interruption of production from the moment of thread breakage to the time when the breakage is discovered by the staff operating the machine. With the control devices described above, however, the production is not interrupted by a yarn breakage. In practice, both filaments do not break at the same time. If however, as is usually the case, only one filament is broken, this filament continues to move together with the unbroken filament since it is highly ply-twisted with the unbroken filament, and texturing is continued without disturbance by means of the friction twist imparter 8. Between the moment of thread breakage and the discovery of the break by the operating staff, the only fault is the absence of exact control of the twist by the control device. Since in most cases the defect lasts only a few minutes, the yarn quality is scarcely affected thereby.

It is to be understood that the term "filaments" in the following claims is to be read as referring either to single filaments or to filament bundles.

We claim:

1. Apparatus for controlling the twist density of filaments of thermoplastic material while the filaments are textured in a processing zone by imparting a temporary high twist to the filaments and heat-setting the filaments in the high-twisted condition, the apparatus comprising a friction twist imparter adapted continuously to ply-twist together two filaments while passing through the processing zone, said friction twist imparter receiving the ply-twisted filaments after traversing the processing zone, means for separating the ply-twisted filaments into two separated filaments at a separation point displaced from said twist imparter along the path of the ply-twisted filaments, means for continuously sensing variations in the position of said separation point along said path, and means responsive to said sensing means for controlling the ply-twist density of the filaments passing through the processing zone by modifying a physical condition of the ply-twisted filaments passing through said friction twist imparter.

2. Apparatus according to claim 1, wherein said friction twist imparter comprises a cylindrical ring mounted to rotate about an axis and through which the ply-twisted filaments pass into contact with said ring, and wherein said controlling means comprises a movable thread-guide to which the ply-twisted yarn passes at an angle to said axis, said sensing means being operative on said controlling means to adjust said angle by moving said thread guide.

3. Apparatus according to claim 1, wherein said sensing means comprises a lever pivotally mounted about an axis and having a portion thereof remote from said axis extending between said separated filaments substantially at said separation point and follower means maintaining said lever portion substantially at said separation point, said controlling means being responsive to said follower means.

4. Apparatus according to claim 2, comprising an arm pivotally mounted about a first axis, said thread-guide being mounted on said arm at a point remote from said first axis, said sensing means comprising a lever pivotally mounted about a second axis and having a portion thereof remote from said second axis extending between said separated filaments substantially at said separation point, a member mounted for to and fro movement, means connecting said member to said lever, a spring acting on said member to maintain said lever portion substantially at said separation point, and mechanism interconnecting said member and said arm whereby the position of said thread-guide is dependent on movements of said member.

5. Apparatus according to claim 2, comprising an arm pivotally mounted about a first axis, said thread-guide being mounted on said arm at a point remote from said first axis, said sensing means comprising a lever pivotally mounted about a second axis and having a portion thereof remote from said second axis extending between said separated filaments substantially at said separation point, a member mounted for to and fro rotary movement and formed with an arcuate peripheral surface, an inelastic cord connecting a point on said peripheral surface to said lever, a torsion spring acting on said member to maintain tension in said cord, thereby maintaining said lever portion substantially at said separation point, and mechanism interconnecting said member and said arm whereby the position of said thread-guide is dependent on movements of said member.

6. Apparatus according to claim 2, comprising an arm pivotally mounted about a first axis, said thread-guide being mounted on said arm at a point remote from said first axis, said sensing means comprising a lever pivotally mounted about a second axis and having a portion thereof remote from said second axis extending between said separated filaments substantially at said separation point, a member mounted for to and fro rotary movement about a third axis, means connecting said member to said lever, a spring acting on said member to maintain said lever portion substantially at said separation point, a worm shaft co-axially fixed to said member, and a worm wheel in mesh with said worm shaft and rotatably mounted on said first axis, said arm being fixed to said worm wheel whereby the position of said thread-guide varies with the position of said separation point.

7. Apparatus according to claim 2, comprising an arm pivotally mounted about a first axis, said thread-guide being mounted on said arm at a point remote from said first axis, said sensing means comprising a lever pivotally mounted about a second axis and having a portion thereof remote from said second axis extending between said separated filaments substantially at said separation point, a member mounted for to and fro rotary movement about a third axis, means connecting said member to said lever, a spring acting on said member to maintain said lever portion substantially at said separation point, a worm-shaft co-axially fixed to said member, a carriage mounted for to and fro linear movement and formed with a screw-thread in mesh with said worm shaft whereby the position of said carriage varies with the position of said separation point, similar discs, spaced from one another and adapted to be driven in opposite directions about parallel fourth and fifth axes fixed with respect to said carriage, a third disc, interposed between and of diameter less than the space between said first mentioned discs, and mounted to rotate about a sixth axis fixed with respect to said third axis, a second worm shaft co-axiallly fixed to said third disc, and a worm wheel in mesh with said worm shaft mounted to rotate about said first axis and fixed to said arm, whereby said thread-guide is moved in one direction when said third disc engages one of said other two discs and in the opposite direction when said third disc engages the other of said other two discs.

8. A process for controlling the twist density of filaments of thermoplastic material while the filaments are textured in a process zone by imparting a temporary high twist to the filaments and heat-setting the filaments in the high-twisted condition, the process comprising the steps of continuously ply-twisting together two filaments, while passing through the process zone, by passing the ply-twisted filaments through a friction twist imparter after traversing the process zone, separating the ply-twisted filaments into two separate filaments at a separation point displaced from said twist imparter along the path of the ply-twisted filaments, continuously sensing the position of said separation point along said path, and controlling the ply-twist density of the filaments passing through the processing zone by modifying a physical condition of the ply-twisted filaments passing through said friction twist imparter in accordance with said sensing step.

9. A process according to claim 8, wherein the ply-twisted filaments pass from said friction twist imparter at a wrap angle with respect to the path travelled by the ply-twisted filaments passing through said friction twist imparter, and wherein the step of controlling the ply-twist density of the filaments is controlled by modifying said wrap angle.

* * * * *